US008151559B2

(12) United States Patent
Okugawa et al.

(10) Patent No.: US 8,151,559 B2
(45) Date of Patent: Apr. 10, 2012

(54) EXHAUST PURIFICATION DEVICE

(75) Inventors: Shinichiro Okugawa, Toyota (JP); Tsukasa Kuboshima, Okazaki (JP)

(73) Assignee: Denso Corporation, Kariya (JP)

( * ) Notice: Subject to any disclaimer, the term of this patent is extended or adjusted under 35 U.S.C. 154(b) by 758 days.

(21) Appl. No.: 12/155,524

(22) Filed: Jun. 5, 2008

(65) Prior Publication Data

US 2008/0314029 A1 Dec. 25, 2008

(30) Foreign Application Priority Data

Jun. 25, 2007 (JP) ..... 2007-166474

(51) Int. Cl.
*F01N 3/00* (2006.01)

(52) U.S. Cl. ..... 60/295; 60/285; 60/286; 60/297

(58) Field of Classification Search ..... 60/285, 60/286, 295, 297, 303
See application file for complete search history.

(56) References Cited

U.S. PATENT DOCUMENTS

| | | | | |
|---|---|---|---|---|
| 6,594,990 | B2 * | 7/2003 | Kuenstler et al. | 60/295 |
| 7,076,944 | B2 | 7/2006 | Okugawa et al. | |
| 7,086,220 | B2 * | 8/2006 | Imai et al. | 60/274 |
| 7,146,799 | B2 * | 12/2006 | Bidner et al. | 60/285 |
| 7,243,491 | B2 * | 7/2007 | Okugawa et al. | 60/311 |
| 7,594,392 | B2 * | 9/2009 | Wang et al. | 60/285 |
| 7,600,373 | B2 * | 10/2009 | Matsuno et al. | 60/295 |
| 2004/0055285 | A1 * | 3/2004 | Rohr et al. | 60/295 |

FOREIGN PATENT DOCUMENTS

| | | |
|---|---|---|
| EP | 1 662 122 | 5/2006 |
| JP | 2005-201142 | 7/2005 |

OTHER PUBLICATIONS

Japanese Office Action dated Apr. 26, 2011, issued in corresponding Japanese Application No. 2007-166474 with English Translation.
Japanese Office Action dated May 26, 2011, issued in corresponding Japanese Application No. 2007-166474 with English Translation.

* cited by examiner

*Primary Examiner* — Thomas Denion
*Assistant Examiner* — Audrey K Bradley
(74) *Attorney, Agent, or Firm* — Nixon & Vanderhye P.C.

(57) ABSTRACT

An exhaust purification device increases temperature of a particulate filter by at least one of a first temperature increase device and a second temperature increase device to combust and remove particulate matters deposited in a particulate filter. The second temperature increase device increases the temperature of the particulate filter to temperature higher than the temperature achieved by the first temperature increase device. An engine output at the time when the second temperature increase device performs the temperature increase operation is equal to an engine output at the time when the first temperature increase device performs the temperature increase operation. The exhaust purification device sets a ratio between an operation period of the first temperature increase device and an operation period of the second temperature increase device according to estimated temperature of the particulate filter.

14 Claims, 4 Drawing Sheets

EXHAUST PURIFICATION DEVICE

CROSS REFERENCE TO RELATED APPLICATION

This application is based on and incorporates herein by reference Japanese Patent Application No. 2007-166474 filed on Jun. 25, 2007.

BACKGROUND OF THE INVENTION

1. Field of the Invention

The present invention relates to an exhaust purification device that collects particulate matters in exhaust gas with a particulate filter provided in an exhaust passage of an internal combustion engine and that combusts the collected particulate matters to regenerate the particulate filter.

2. Description of Related Art

In recent years, an exhaust purification device that performs treatment of exhaust gas discharged from an internal combustion engine with a catalyst or a filter to reduce emission of harmful components is becoming more and more important. For example, a known exhaust purification device has a particulate filter provided in an exhaust passage for collecting particulate matters discharged from a diesel engine (for example, as described in Patent document 1: JP-A-2004-301013). The particulate matters deposited in the particulate filter are regularly combusted and removed to regenerate the particulate filter, whereby the particulate filter can be continuously used.

The particulate filter is regenerated by increasing the temperature of the particulate filter to temperature (for example, 600 degrees C. or over), at which the particulate matters combust, when a particulate matter deposition quantity exceeds a predetermined value. For example, the particulate matter deposition quantity is computed on the basis of differential pressure between an upstream side and a downstream side of the particulate filter.

However, fuel consumption is deteriorated if the temperature of the particulate filter is increased to combust the particulate matters by well-known methods such as a post-injection of injecting fuel at a later crank angle than a main injection, which produces a main engine output, or throttling of an intake air.

When the increased temperature of the particulate filter is excessively low, combustion speed of the particulate matters becomes slow and hence the time required to regenerate the particulate filter becomes long and hence the fuel consumption is further deteriorated. Conversely, as the increased temperature of the particulate filter is increased more, the combustion speed of the particulate matters becomes faster and hence the regeneration of the particulate filter is finished in a shorter time, so the deterioration in the fuel consumption accompanying the regeneration of the particulate filter is reduced. However, when the temperature of the particulate filter is increased to excessively high temperature, the particulate filter may be damaged or an oxidation catalyst supported by the particulate filter may be degraded.

In order to prevent the deterioration in the fuel consumption and to regenerate the particulate filter safely, the temperature of the particulate filter needs to be maintained near specified temperature. The technology described in Patent document 1 aims to control the increased temperature of the particulate filter to specified temperature with high accuracy by switching between execution and stoppage of temperature increase operation by a temperature increase device in accordance with a time ratio.

However, if the execution and the stoppage by the temperature increase operation of the temperature increase device are switched in accordance with the time ratio as described in Patent document 1, there is a possibility that the engine output fluctuates due to the switching between the execution and the stoppage of temperature increase operation by the temperature increase device, depending on the operation state of the internal combustion engine.

SUMMARY OF THE INVENTION

It is an object of the present invention to provide an exhaust purification device that controls increased temperature of a particulate filter with high accuracy and that reduces a fluctuation in an engine output when the temperature of the particulate filter is increased to regenerate the particulate filter.

According to an aspect of the present invention, temperature of a particulate filter is increased by at least one of a first temperature increase device and a second temperature increase device to combust and remove particulate matters deposited in a particulate filter. The second temperature increase device increases the temperature of the particulate filter to temperature higher than the temperature achieved by the first temperature increase device. An engine output at the time when the second temperature increase device performs the temperature increase operation is equal to an engine output at the time when the first temperature increase device performs the temperature increase operation. A ratio between an operation period of the first temperature increase device and an operation period of the second temperature increase device is set according to estimated temperature of the particulate filter.

With the construction, the increased temperature of the particulate filter can be controlled with high accuracy between the increased temperature by the first temperature increase device and the increased temperature by the second temperature increase device by regulating the ratio between the operation period of the temperature increase operation by the first temperature increase device and the operation period of the temperature increase operation by the second temperature increase device, which are different from each other in the increased temperature.

Moreover, even though the temperature increase operation by the first temperature increase device and the temperature increase operation by the second temperature increase device are switched according to the set ratio, the increased temperature of the particulate filter can be easily controlled without changing the engine output.

According to another aspect of the present invention, the first temperature increase device and the second temperature increase device are operated according to the set ratio within a period of a specified cycle for each specified cycle. A duty ratio of the operation period of the second temperature increase device to the specified cycle is set according to the estimated temperature of the particulate filter.

With the construction, the execution cycle of the temperature increase operation by the set of the first temperature increase device and the second temperature increase device is constant. Therefore, the first temperature increase device and the second temperature increase device can be switched according to the duty ratio within the period of the constant cycle. As a result, the switching control between the first temperature increase device and the second temperature increase device is easily performed.

If the execution cycle of the temperature increase operation by the set of the first temperature increase device and the second temperature increase device is excessively long with respect to the response of the temperature change of the particulate filter to be increased to target temperature, temperature fluctuation of the particulate filter enlarges when the temperature of the particulate filter is increased by switching between the first temperature increase device and the second temperature increase device. As a result, the temperature of the particulate filter cannot be controlled with high accuracy.

Therefore, according to another aspect of the present invention, the execution cycle of the temperature increase operation by the set of the first temperature increase device and the second temperature increase device is set to be equal to or shorter than the 63% response time (time constant) of the temperature increase of the particulate filter to the target temperature.

With the construction, the temperature increase operation is switched between the first temperature increase device and the second temperature increase device within the response time of the time constant after the temperature increase operation is started. Accordingly, a fluctuation in the temperature of the particulate filter can be reduced. As a result, the temperature of the particulate filter can be controlled with high accuracy.

According to another aspect of the present invention, the target temperature, to which the temperature of the particulate filter is increased, is computed on the basis of a particulate deposition quantity.

With the construction, the temperature of the particulate filter can be increased to the target temperature suitable for regenerating the particular filter according to the particulate deposition quantity deposited in the particulate filter.

According to another aspect of the present invention, the ratio between the operation periods of the first temperature increase device and the second temperature increase device is set according to the magnitude of the deviation between the target temperature and the estimated temperature of the particulate filter.

With the construction, the temperature of the particulate filter can be increased with high accuracy to the target temperature suitable for regenerating the particular filter according to the magnitude of the deviation between the target temperature and the estimated temperature of the particulate filter. Moreover, for example, the temperature of the particulate filter can be quickly approximated to the target temperature by increasing the ratio of the operation period of the second temperature increase device when the deviation between the target temperature and the estimated temperature of the particulate filter is large.

According to another aspect of the present invention, the second temperature increase device decreases a main injection quantity as compared to the first temperature increase device and increases a post-injection quantity as compared to the first temperature increase device when the first temperature increase device and the second temperature increase device control an injector to increase the temperature of the particulate filter.

The temperature of the particulate filter can be increased more as the post-injection quantity increases. Therefore, the second temperature increase device, which increases the post-injection quantity as compared to the first temperature increase device, can increase the temperature of the particulate filter to higher temperature than the temperature achieved by the first temperature increase device.

The second temperature increase device that increases the post-injection quantity as compared to the first temperature increase device can increase the temperature of the particulate filter to higher temperature than the temperature achieved by the first temperature increase device whereas the main injection quantity of the second temperature increase device is smaller than the main injection quantity of the first temperature increase device. With the configuration, the engine output is substantially the same in both cases of the first temperature increase device and the second temperature increase device even through part of the post-injection quantity is combusted in the internal combustion engine and produces part of the engine output.

When the temperature of the particulate filter is low and therefore an oxidation catalyst provided upstream of the particulate filter or an oxidation catalyst supported by the particulate filter is not activated, the fuel injected by the post-injection is not sufficiently oxidized by the oxidation catalyst and is discharged as unburned fuel by passing the particulate filter.

Therefore, according to another aspect of the present invention, when the estimated temperature of the particulate filter is lower than specified temperature, the ratio between the operation periods of the first temperature increase device and the second temperature increase device is set such that the temperature increase operation of the particulate filter is performed by only the first temperature increase device.

With the construction, the temperature of the particulate filter is increased by only the first temperature increase device that provides the smaller post-injection quantity than that of the second temperature increase device. Accordingly, passage of the unburned fuel through the particulate filter can be minimized.

According to another aspect of the present invention, the second temperature increase device throttles an intake air quantity more than the first temperature increase device does when the first temperature increase device and the second temperature increase device control an intake air throttle valve to increase the temperature of the particulate filter.

When the intake air quantity is throttled to decrease the intake air quantity suctioned into the internal combustion engine, the quantity of gas, the temperature of which is increased by combustion, is decreased, so the exhaust gas temperature is increased. The second temperature increase device can increase the temperature of the particulate filter to higher temperature than the temperature achieved by the first temperature increase device by throttling the intake air quantity more than the first temperature increase device does.

The engine output is substantially the same even though the intake air quantity changes between the first temperature increase device and the second temperature increase device as long as the intake air quantity is within a range where the intake air quantity is greater than a specified quantity.

According to yet another aspect of the present invention, the temperature of the particulate filter is estimated on the basis of an output of a temperature sensor provided in at least one of upstream and downstream of the particulate filter.

The temperature of the particulate filter changes according to the temperature of exhaust gas flowing into or flowing out of the particulate filter. Therefore, the temperature of the particulate filter can be estimated with high accuracy by assuming the output of the temperature sensor to be the temperature of the particulate filter or on the basis of the output of the temperature sensor. The temperature of the particulate filter can be estimated with higher accuracy by considering the response or the like at the time when a thermal capacity and the temperature of the particulate filter change with respect to the output of the temperature sensor.

The respective functions of the multiple devices according to the aspects of the present invention are realized by hardware sources having functions specified by the structures thereof, hardware sources having functions specified by programs or a combination of the both types of hardware sources. The respective functions of the multiple device are not limited to the functions realized by the hardware sources physically independent from each other.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Hereinafter, embodiments of the present invention will be described with reference to the drawings.

Figure 1:
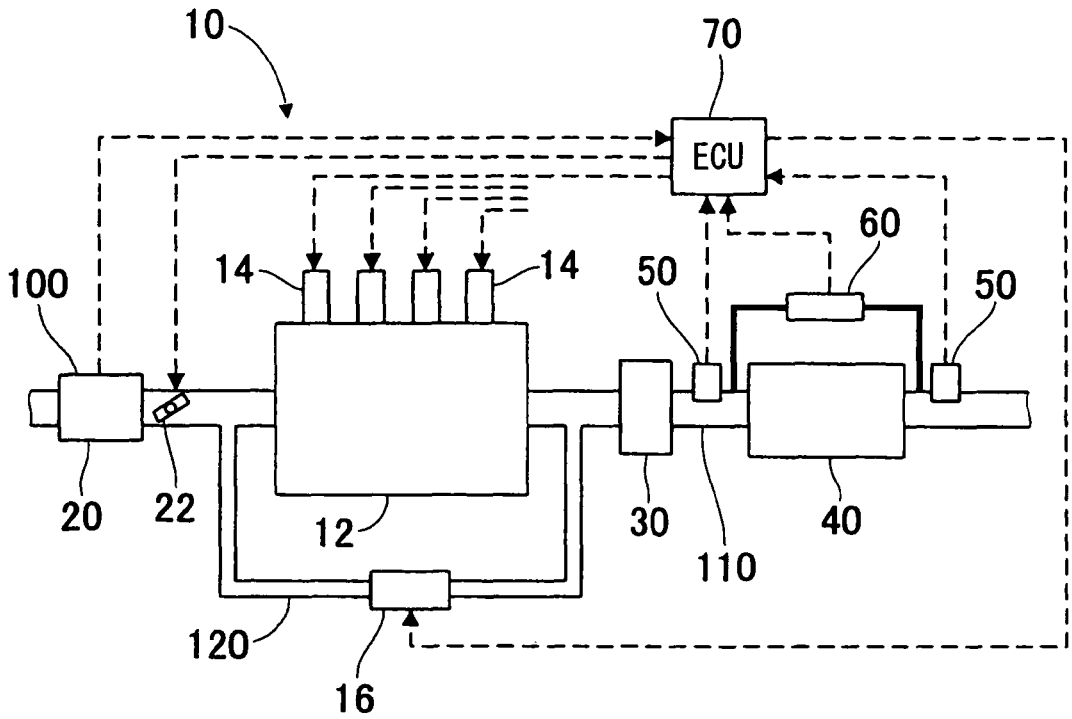
FIG. 1 is a construction diagram showing an exhaust purification system according to an embodiment of the present invention.

An exhaust purification system 10 shown in FIG. 1 purifies exhaust gas of a diesel engine 12. Fuel is injected into respective cylinders of the four-cylinder engine 12 from respective injectors 14. Fuel accumulated at specified pressure is supplied from a common rail (not shown) to the injectors 14. An intake pipe 100 is connected to an upstream side of the engine 12 and an exhaust pipe 110 is connected to a downstream side of the engine 12. An EGR valve 16 (exhaust gas recirculation valve) is provided in an EGR pipe 120 connecting the intake pipe 100 and the exhaust pipe 110. The EGR valve 16 controls a quantity of the exhaust gas (EGR quantity) recirculated from the exhaust side to the intake side in response to a command from an ECU 70.

In the intake pipe 100, an air flow meter 20 is provided upstream of a connection between the intake pipe 100 and the EGR pipe 120 and an intake air throttle valve 22 is provided downstream of the air flow meter 20. The intake air throttle valve 22 controls the quantity of intake air suctioned into the engine 12 from the intake pipe 100.

In the exhaust pipe 110, a diesel oxidation catalyst 30 (DOC) is provided downstream of a connection between the exhaust pipe 110 and the EGR pipe 120 and a diesel particulate filter 40 (DPF) is provided downstream of the DOC 30.

The DOC 30 has a well-known structure formed by supporting an oxidation catalyst on a surface of a ceramic support having a honeycomb structure or the like made of a cordierite. The DOC 30 combusts hydrocarbon (HC) of unburned fuel supplied to the exhaust pipe 110 by a catalytic reaction to increase exhaust gas temperature, thereby increasing temperature of the DPF 40. An oxidation catalyst may be or may not be supported on the DPF 40. In the following description, the present embodiment will be described on an assumption that the oxidation catalyst is not supported on the DPF 40.

The DPF 40 constituting an exhaust purification device is a filter of a well-known structure made of a ceramic. For example, the DPF 40 is made by forming a heat-resistant ceramic such as a cordierite into a honeycomb structure and by alternately blocking an inlet or an outlet of each of multiple cells defining gas flow passages. While the exhaust gas discharged from the engine 12 flows downward through porous partition walls of the DPF 40, particulate matters (PM) contained in the exhaust gas are collected by and deposited in the DPF 40.

Exhaust gas temperature sensors 50 as temperature sensors are provided to the exhaust pipe 110 upstream and downstream of the DPF 40 respectively. The exhaust gas temperature sensors 50 sense temperature of gases flowing into and out of the DPF 40 and output the sensed temperature to the ECU 70. Alternatively, the exhaust gas temperature sensor 50 may be provided either upstream or downstream of the DPF 40 instead of providing the exhaust gas temperature sensors 50 both upstream and downstream of the DPF 40.

In order to determine a deposition quantity of the particulate matters (PM deposition quantity) collected by the DPF 40, a differential pressure sensor 60 for sensing differential pressure between the upstream side and the downstream side of the DPF 40 is connected to the exhaust pipe 110 upstream and downstream of the DPF 40.

The ECU 70 constituting the exhaust purification device is composed of a microcomputer having a CPU, a ROM, a RAM, a flash memory and the like as main components. The ECU 70 senses an operation state of the engine 12 on the basis of sensing signals from various sensors (not shown) such as an accelerator position sensor and a rotation speed sensor. The ECU 70 computes an optimal fuel injection quantity, injection timing, injection pressure and the like in accordance with the operation state of the engine 12 and controls the fuel injection of the injectors 14. The ECU 70 controls an opening degree of the EGR valve 16 to control the EGR quantity and controls an opening degree of the intake air throttle valve 22 to control an intake air quantity to the engine 12.

The ECU 70 functions as the respective following devices by exhaust purification control programs stored in the storage device such as the ROM or the flash memory.

(1) Deposition Quantity Estimation Device:

The ECU 70 estimates the PM deposition quantity in the DPF 40 from the sensing signal of the differential pressure sensor 60. When an exhaust gas flow rate is constant, the differential pressure between the upstream side and the downstream side of the DPF 40 increases as the PM deposition quantity increases. Therefore, the PM deposition quantity can be estimated by measuring this relationship in advance. An absolute pressure sensor may be used in place of the differential pressure sensor 60. Alternatively, the PM deposition quantity may be estimated on the basis of the operation state of the engine 12 such as the operation position of the accelerator or the rotation speed of the engine 12.

(2) Temperature Estimation Device:

The ECU 70 estimates the temperature of the DPF 40 on the basis of the sensing signals of the exhaust gas temperature sensors 50. It is also possible to provide the exhaust gas temperature sensor 50 on only either one of the upstream side and the downstream side of the DPF 40 and to estimate the temperature of the DPF 40 from the exhaust gas temperature on the upstream side or the downstream side of the DPF 40.

(3) Target Temperature Computation Device:

The ECU 70 computes target temperature, to which the temperature of the DPF 40 is increased, from the PM deposition quantity estimated from the sensing signal of the differential pressure sensor 60. For example, when the PM deposition quantity is large, in order to prevent rapid combustion of the particulate matters and rapid increase in the temperature of the DPF 40, the ECU 70 lowers the target temperature to be lower than in the case where the PM deposition quantity is small.

(4) First Temperature Increase Device, Second Temperature Increase Device:

The ECU 70 controls a post-injection quantity of the injector 14 to increase the quantity of HC as an unburned component in the exhaust gas, thereby increasing the temperature of the DPF 40 by the reaction heat of the HC generated in the DOC 30. The post-injection is performed to regenerate the DPF 40 at a crank angle later than a main injection that produces a main engine output.

Figure 2:
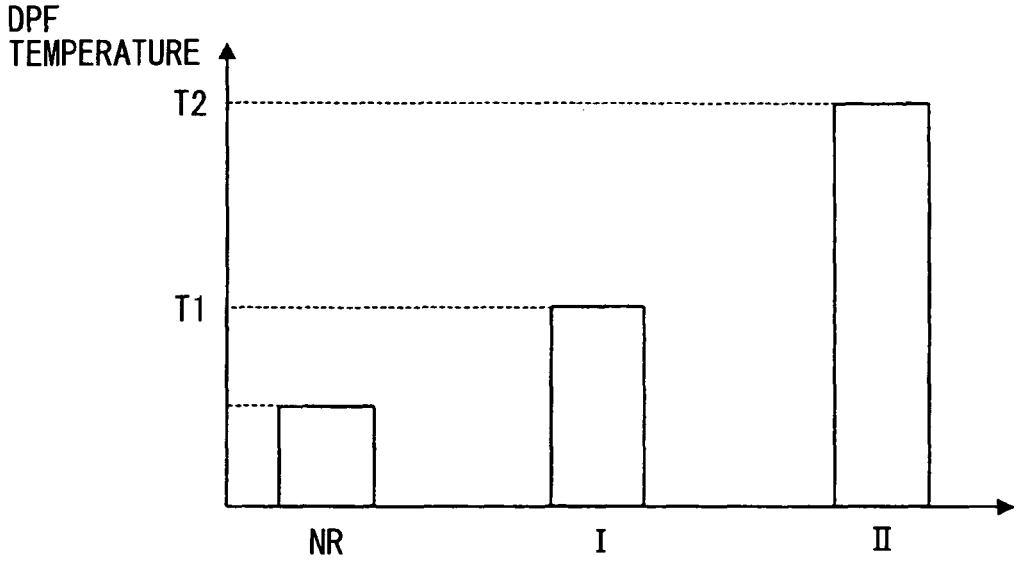
FIG. 2 is a graph showing a difference in temperature of a DPF between a non-regeneration period and a regeneration period of the DPF according to the embodiment.

As shown in FIG. 2, as compared to a non-regeneration period (NR in FIG. 2) in which neither the first temperature increase device nor the second temperature increase device is performed and therefore the post-injection is not performed, the temperature of the DPF 40 is increased to temperature T1 by the first temperature increase device (I in FIG. 2) when the first temperature increase device is operated or the temperature of the DPF 40 is increased to temperature T2 by the second temperature increase device (II in FIG. 2) when the second temperature increase device is operated. The temperature of the DPF 40 is more increased as the post-injection quantity is increased more. The post-injection quantity injected by the second temperature increase device is larger than the post-injection quantity injected by the first temperature increase device and the temperature T2 is higher than the temperature T1.

Part of the fuel of the post-injection is combusted in the cylinder of the engine 12 and causes increase in the engine output. Therefore, the second temperature increase device providing the post-injection quantity larger than that of the first temperature increase device reduces the main injection quantity as compared to the first temperature increase device. Thus, the engine output is substantially the same between the temperature increase operation by the first temperature increase device and the temperature increase operation by the second temperature increase device.

Figure 3:
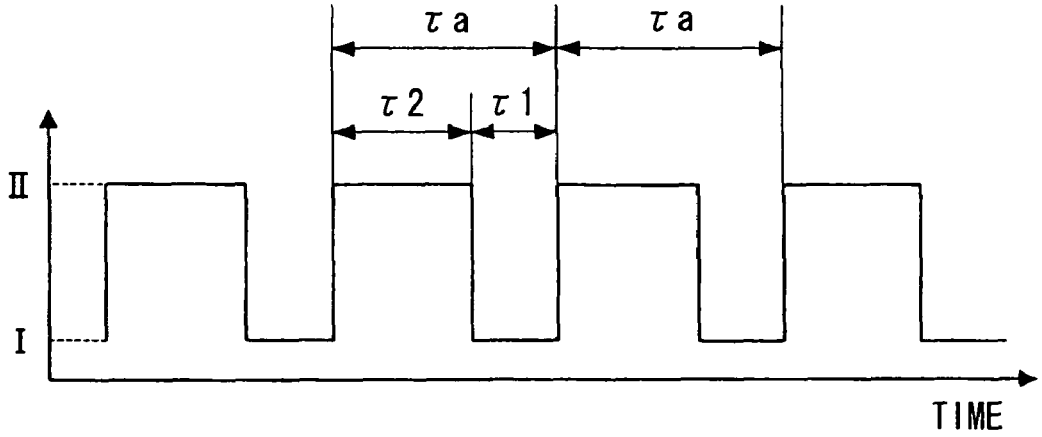
FIG. 3 is a graph showing a setting of duty ratios of a first temperature increase device and a second temperature increase device according to the embodiment.

(5) Operation Ratio Setting Device:

The ECU 70 sets a specified cycle equal to or shorter than the 63% response time (time constant) of the temperature increase of the DPF 40 to the target temperature and sets a ratio between operation periods of the first temperature increase device and the second temperature increase device within a period of the specified cycle. In the present embodiment, as shown in FIG. 3, the ECU 70 sets a duty ratio of an operation period $\tau 2$ of the second temperature increase device to the specified cycle $\tau a$.

Figure 4:
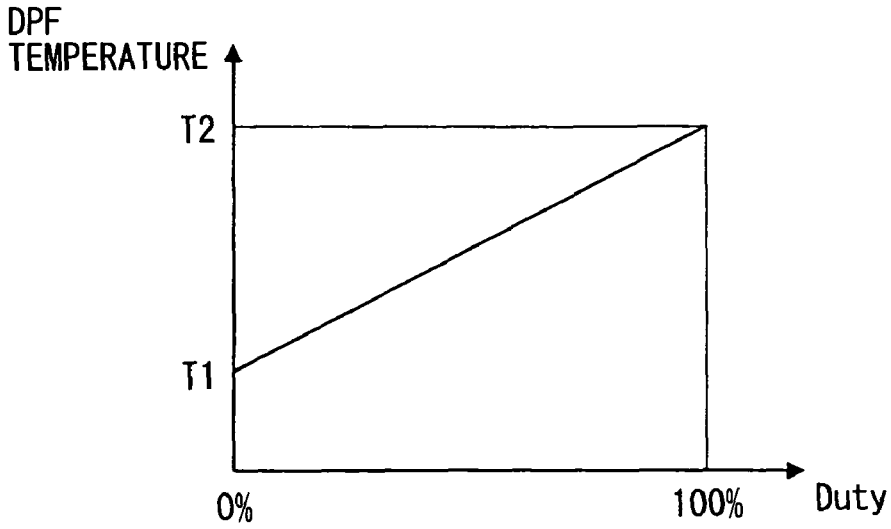
FIG. 4 is a characteristic graph showing a relationship between the duty ratio and the temperature of the DPF according to the present embodiment.

As shown in FIG. 4, the target temperature, to which the temperature of the DPF 40 is to be increased, can be set in a range from T1 to T2 with high accuracy by setting the duty ratio (Duty in FIG. 4) in a range from 0% to 100%. The duty ratio may be continuously changed in the range from 0% to 100%. Alternatively, multiple duty ratios may be set and the duty ratio may be changed stepwise among the multiple duty ratios. When the duty ratio is increased and hence the ratio of the operation period $\tau 2$ of the second temperature increase device to the operation period $\tau 1$ of the first temperature increase device is increased, the temperature of the DPF 40 increases.

The post-injection quantity of the second temperature increase device is computed from a two-dimensional map of the rotation speed of the engine and the operation position of the accelerator such that the temperature of the DPF 40 is brought to a specified value higher than the target temperature under each operation condition of the engine 12 when the temperature increase operation is performed only with the second temperature increase device at the duty ratio of 100%.

When the exhaust gas temperature is high, the ECU 70 decreases the duty ratio because a request for temperature increase through the post-injection is low. When the exhaust gas temperature is low, the ECU 70 increases the duty ratio because a request for the temperature increase through the post-injection is high. However, when the exhaust gas temperature is lower than specified temperature (for example, 200 degrees C.) and hence the oxidation catalyst of the DOC 30 is not activated, the unburned fuel discharged into the DOC 30 through the post-injection is not burned in the DOC 30 but passes through the DPF 40 in the unburned state. In order to prevent this, when the exhaust gas temperature is lower than the specified temperature, the ECU 70 may set the duty ratio, for example, to 0% to perform the temperature increase operation of the DPF 40 only with the first temperature increase device.

(6) Regeneration Device:

When the PM deposition quantity exceeds a predetermined value, the ECU 70 operates either one of the first temperature increase device and the second temperature increase device to increase the temperature of the DPF 40 to the target temperature. Thus, the deposited particulate matters are burned and removed, thereby regenerating the DPF 40.

Figure 5:
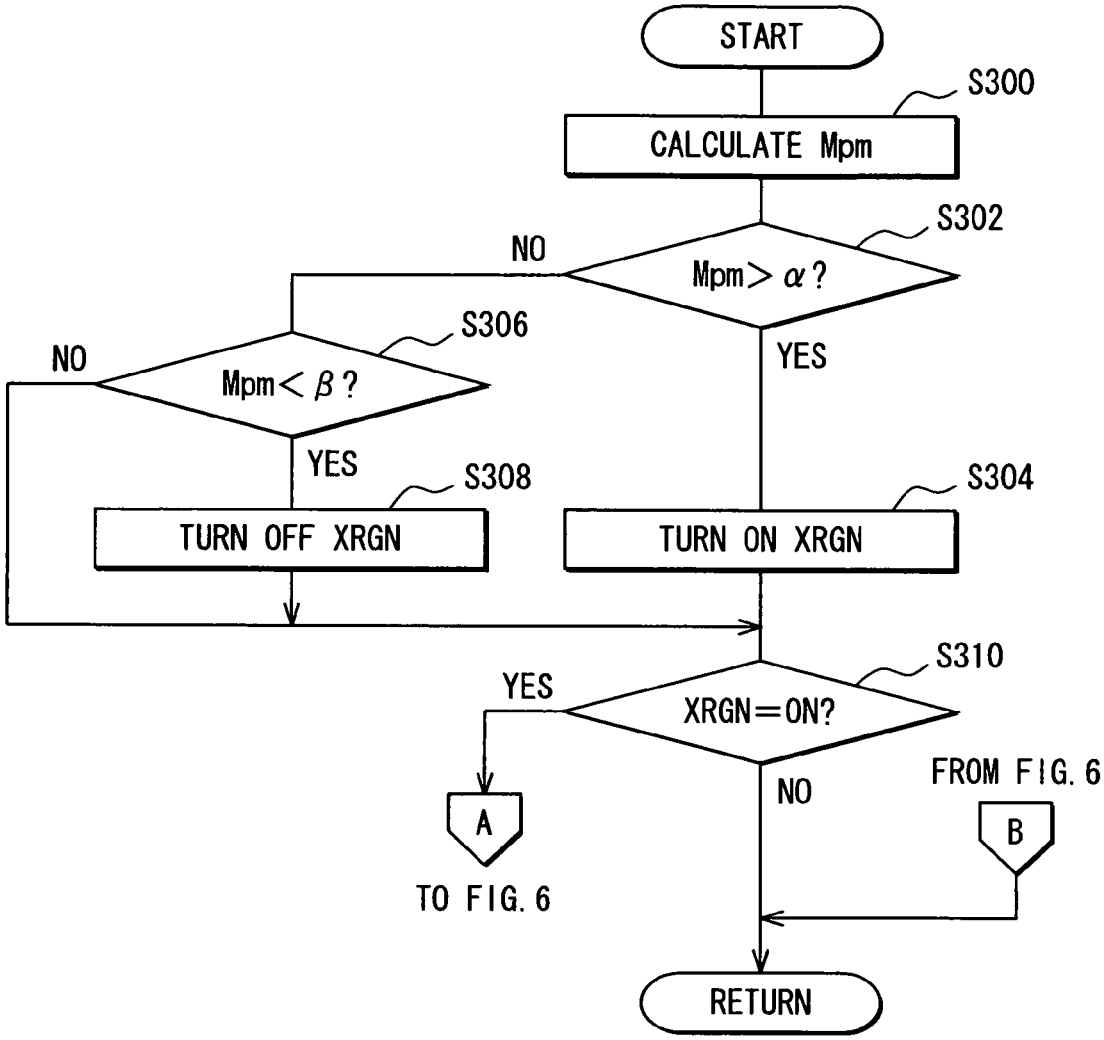
FIGS. 5 and 6 are parts of a flowchart showing a regeneration routine according to the embodiment.
Figure 6:
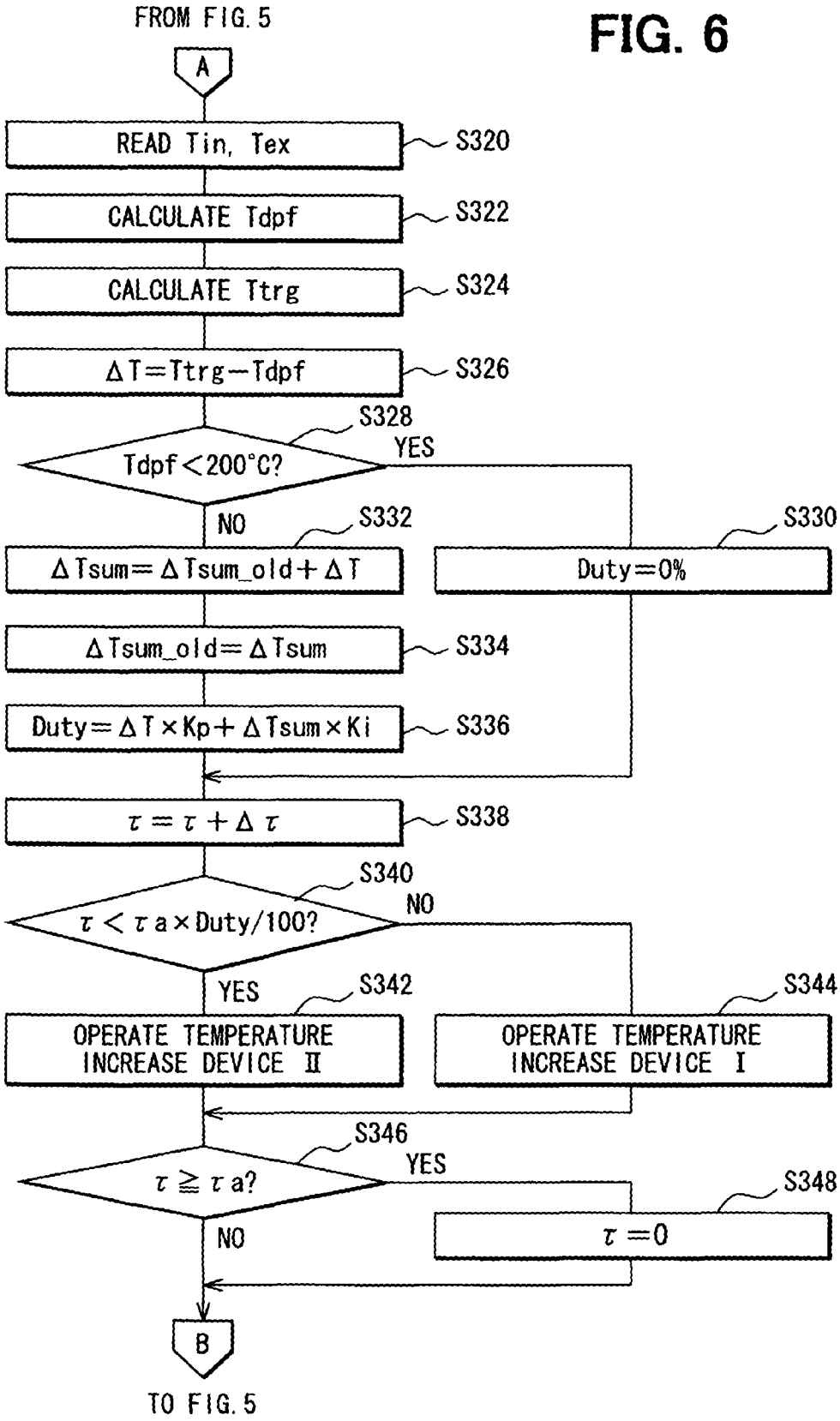

Next, the regeneration of the DPF 40 will be described. FIGS. 5 and 6 show a flowchart showing a regeneration routine of the DPF 40. The regeneration routine shown in FIGS. 5 and 6 is executed in a predetermined cycle $\Delta\tau$ by timer interruption. In FIGS. 5 and 6, "S" designates a step.

First, in S300 of FIG. 5, the ECU 70 computes the differential pressure between the upstream side and the downstream side of the DPF 40 from the sensing signal of the differential pressure sensor 60 and computes and estimates the PM deposition quantity Mpm deposited in the DPF 40 on the basis of the differential pressure and the exhaust gas flow rate computed from the output of the air flow meter 20.

In S302, the ECU 70 determines whether the PM deposition quantity Mpm is greater than a specified value $\alpha$. When the PM deposition quantity Mpm is greater than the specified value $\alpha$, the ECU 70 turn on a flag XRGN in S304 and shifts the processing to S310.

When the PM deposition quantity Mpm is equal to or less than the specified value $\alpha$, the ECU 70 determines in S306 whether the PM deposition quantity Mpm is less than a specified value $\beta$. The specified value $\alpha$ is greater than the specified value $\beta$. When the PM deposition quantity Mpm is less than the specified value $\beta$, the ECU 70 turns off the flag XRGN in S308 and shifts the processing to S310. When the PM deposition quantity Mpm is equal to or greater than the specified value $\beta$, the ECU 70 shifts the processing to S310 without changing the flag XRGN.

In S310, the ECU 70 determines whether the flag XRGN is on. When the flag XRGN is off, the ECU 70 ends the routine. When the flag XRGN is on, the ECU 70 shifts the processing to S320 shown in FIG. 6 to execute the regeneration processing of the DPF 40.

When the PM deposition quantity Mpm deposited in the DPF 40 increases and exceeds the specified value $\alpha$, the flag XRGN is set on and is held set on until the regeneration processing of the DPF 40 is performed and the PM deposition quantity Mpm deposited in the DPF 40 decreases to a value less than the specified value $\beta$.

In S320, the ECU 70 reads the sensing signals of the exhaust gas temperature sensors 50 provided upstream and downstream of the DPF 40 to sense exhaust gas temperature Tin of the exhaust gas flowing into the DPF 40 and exhaust gas temperature Tex of the exhaust gas flowing out of the DPF 40. In S322, the ECU 70 computes and estimates estimation temperature Tdpf of the DPF 40 from the sensed exhaust gas temperatures Tin, Tex.

In S324, the ECU 70 computes regeneration target temperature Ttrg, to which the temperature of the DPF 40 is to be increased, from the PM deposition quantity Mpm. In S326, the ECU 70 computes a deviation ΔT between the regeneration target temperature Ttrg and the estimation temperature Tdpf of the DPF 40.

In S328, the ECU 70 determines whether the estimation temperature Tdpf of the DPF 40 is lower than 200 degrees C. as lower limit activation temperature of the oxidation catalyst. When Tdpf<200 degrees C., the ECU 70 determines that the oxidation catalyst is not activated and hence determines that the temperature increasing effect cannot be exerted even if the HC is supplied to the DOC 30. In this case, in S330, the ECU 70 sets the duty ratio to 0%, at which the temperature increase operation is performed only with the first temperature increase device. Then, the ECU 70 shifts the processing to S338.

When Tdpf≧200 degrees C. in S328, the ECU 70 adds the deviation ΔT computed in S326 to an integration value ΔTsum_old of the deviation ΔT to calculate a value ΔTsum in S332 and sets the new value ΔTsum as the integration value ΔTsum_old in S334.

In S336, the ECU 70 computes a duty ratio (Duty) for operating the second temperature increase device based on a following equation (1).

$$\text{Duty}=\Delta T\times Kp+\Delta T\text{sum}\times Ki, \quad (1)$$

In the equation (1), Kp, Ki are feedback gains. The equation (1) expresses that the duty ratio of the second temperature increase device is set by performing feedback control on the basis of the deviation ΔT and the value ΔTsum.

In S338, the ECU 70 adds the execution cycle Δτ of the regeneration routine to an integration counter τ.

In S340, the ECU 70 determines whether the value of the integration counter τ satisfies a following inequality (2).

$$\tau<\tau a\times\text{Duty}/100, \quad (2)$$

The right side of the inequality (2) expresses the operation period of the second temperature increase device. That is, in S340, the ECU 70 determines whether the integration period (τ), in which the temperature of the DPF 40 is increased by operating the second temperature increase device, is shorter than a specified operation period of the second temperature increase device set by the duty ratio.

When the equality (2) is satisfied, that is, when the integration period (τ) is shorter than the specified operation period of the second temperature increase device, the execution of the temperature increase operation by the second temperature increase device is still necessary. Therefore, in this case, in S342, the ECU 70 performs the temperature increase operation by the second temperature increase device. When the inequality (2) is not satisfied, the ECU 70 determines that it is required to end the execution of the temperature increase operation by the second temperature increase device and to perform the temperature increase operation by the first temperature increase device. In this case, in S344, the ECU 70 performs the temperature increase operation by the first temperature increase device.

Then, in S346, the ECU 70 determines whether the value of the integration counter τ of the operation period of the temperature increase by the first temperature increase device and the second temperature increase device becomes equal to or greater than the period of the specified cycle τa for operating the first temperature increase device and the second temperature increase device as a set. When τ≧τa, the ECU 70 clears the integration counter τ to zero in S348 for the execution of the temperature increase operation in the next cycle and ends the routine. When τ<τa, the ECU 70 determines that the integration (τ) of the operation period of the temperature increase by the first temperature increase device and the second temperature increase device has not reached the period of the specified cycle (τa) yet, and the ECU 70 ends the routine without changing the value of the integration counter τ.

In the present embodiment described above, the temperature of the DPF 40 is increased by the first temperature increase device and the second temperature increase device that are equal to each other in the value of the output of the engine 12 even when the temperature increase operation of the DPF 40 is performed. Thus, even though the temperature increase operation is switched between the first temperature increase device and the second temperature increase device, the output of the engine 12 is unchanged.

The temperature increase operation is switched between the first temperature increase device and the second temperature increase device, which cause the different increased temperatures, according to the duty ratio. Therefore, the temperature of the DPF 40 can be controlled with high accuracy between the increased temperature T1 by the first temperature increase device and the increased temperature T2 by the second temperature increase device.

The execution cycle of the set of the first temperature increase device and the second temperature increase device is a constant value and is unchanged. Therefore, the temperature of the DPF 40 can be easily controlled by changing the duty ratio.

In the present embodiment, the execution cycle τa of the temperature increase operation by the set of the first temperature increase device and the second temperature increase device is set at a period equal to or shorter than the 63% response time (time constant) of the temperature increase of the DPF 40 to the target temperature. Accordingly, the temperature increase operation is switched between the first temperature increase device and the second temperature increase device within the period of the time constant after the temperature increase operation of the DPF 40 is stared. Therefore, fluctuation of the temperature of the DPF 40 during the temperature increase operation is reduced. As a result, the temperature of the DPF 40 can be controlled with high accuracy.

The duty ratio is set according to the magnitude of the deviation between the target temperature, to which the temperature of the DPF 40 is increased for the regeneration, and the temperature of the DPF 40 computed with the exhaust gas temperature sensors 50. Therefore, the temperature of the DPF 40 can be increased to the target temperature with high accuracy.

In the embodiment described above, the temperature of the DPF 40 is increased by adjusting the post-injection quantity. Alternatively, a fuel addition unit may be provided to the exhaust pipe 110 upstream of the DOC 30 and may directly supply the HC into the exhaust pipe 110. The temperature of the DPF 40 increases if the quantity of the fuel additionally supplied into the exhaust pipe 110 from the fuel addition unit increases. Alternatively, the temperature of the DPF 40 may be increased by adjusting a throttling amount of the intake air throttle valve 22 within a range in which the output of the engine 12 does not increase or decrease. When an intake air quantity is throttled by the intake air throttle valve 22 and hence an intake air flow rate is decreased, the temperature of exhaust gas discharged from the engine 12 to the exhaust pipe 110 increases and hence the temperature of the DPF 40 also increases.

In the case of the construction as in the above embodiment in which the EGR valve 16 is provided to recirculate part of the exhaust gas to the intake side, the exhaust gas temperature may be adjusted by controlling the EGR quantity with the EGR valve 16 and the increased temperature of the DPF 40 may be controlled without increasing or decreasing the output of the engine 12. When the EGR quantity is increased, the exhaust gas temperature increases and hence the temperature of the DPF 40 increases.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An exhaust purification device comprising:

a particulate filter provided in an exhaust passage of an internal combustion engine for collecting particulate matters in exhaust gas;

a first temperature increase means for increasing temperature of the particulate filter;

a second temperature increase means for increasing the temperature of the particulate filter to temperature higher than the temperature achieved by the first temperature increase means, wherein a value of an engine output at the time when the second temperature increase means performs the temperature increase operation is equal to a value of the engine output at the time when the first temperature increase means performs the temperature increase operation;

a temperature estimation means for estimating the temperature of the particulate filter;

a deposition quantity estimation means for estimating a particulate deposition quantity deposited in the particulate filter;

a regeneration means for regenerating the particulate filter by increasing the temperature of the particulate filter with the use of at least one of the first temperature increase means and the second temperature increase means and by combusting and removing the deposited particulate matters when the particulate deposition quantity estimated by the deposition quantity estimation means is greater than a specified value;

an operation ratio setting means for setting a ratio between an operation period of the first temperature increase means and an operation period of the second temperature increase means according to the temperature of the particulate filter estimated by the temperature estimation means; and a target temperature computation means for computing target temperature, to which the temperature of the particulate filter is to be increased, on the basis of the particulate deposition quantity, wherein:

the first temperature increase means and the second temperature increase means are operated according to the ratio within a period of a specified cycle for each specified cycle; and the specified cycle is set to be equal to or shorter than a 63% response time of the temperature increase of the particulate filter to the target temperature.

2. The exhaust purification device as in claim 1, wherein the operation ratio setting means sets a duty ratio of the operation period of the second temperature increase means to the specified cycle according to the temperature of the particulate filter estimated by the temperature estimation means.

3. The exhaust purification device as in claim 1, wherein the operation ratio setting means sets the ratio according to a magnitude of a deviation between the target temperature and the estimated temperature estimated by the temperature estimation means.

4. The exhaust purification device as in claim 1, wherein the internal combustion engine has an intake air throttle valve in an intake passage thereof for regulating an intake air quantity of the intake passage, and the second temperature increase means throttles the intake air quantity more than the first temperature increase means does when the first temperature increase means and the second temperature increase means control the intake air throttle valve to increase the temperature of the particulate filter.

5. The exhaust purification device as in claim 1, wherein the temperature estimation means estimates the temperature of the particulate filter on the basis of an output of a temperature sensor provided at least one of upstream and downstream of the particulate filter.

6. The exhaust purification device as in claim 1, wherein the internal combustion engine has an injector for injecting fuel into each cylinder of the internal combustion engine in an injection mode of performing a main injection to produce a main engine output and at least one post-injection at a later crank angle than the main injection in a single heat cycle of the internal combustion engine, and the second temperature increase means decreases an injection quantity of the main injection as compared to the first temperature increase means and increases an injection quantity of the post-injection as compared to the first temperature increase means when the first temperature increase means and the second temperature increase means control the injector to increase the temperature of the particulate filter.

7. The exhaust purification device as in claim 6, wherein the operation ratio setting means sets the ratio so as to perform the temperature increase operation only with the first temperature increase means when the estimated temperature estimated by the temperature estimation means is lower than specified temperature.

8. A method comprising:

increasing temperature of a particulate filter in a first temperature increase, the particulate filter being provided in an exhaust passage of an internal combustion engine for collecting particulate matters in exhaust gas;

increasing temperature of the particulate filter in a second temperature increase to temperature higher than the temperature achieved by the first temperature increase, wherein a value of an engine output at the time when the second temperature increase is performed is equal to a value of the engine output at the time when the first temperature increase is performed;

estimating the temperature of the particulate filter;

estimating a particulate deposition quantity deposited in the particulate filter;

regenerating the particulate filter by increasing the temperature of the particulate filter using at least one of the first temperature increase and the second temperature increase and by combusting and removing the deposited particulate matters when the estimated particulate deposition quantity is greater than a specified value;

setting a ratio between an operation period of the first temperature increase and an operation period of the second temperature increase according to the estimated temperature of the particulate filter; and computing a target temperature, to which the temperature of the particulate filter is to be increased, on the basis of the particulate deposition quantity, wherein:

the first temperature increase and the second temperature increase are operated according to the ratio within a period of a specified cycle for each specified cycle; and the specified cycle is set to be equal to or shorter than a 63% response time of the temperature increase of the particulate filter to the target temperature.

9. The method as in claim 8, wherein a duty ratio of the operation period of the second temperature increase to the specified cycle is set according to the estimated temperature of the particulate filter.

10. The method as in claim 8, wherein the ratio is set according to a magnitude of a deviation between the target temperature and the estimated temperature.

11. The method as in claim 8, wherein the internal combustion engine has an intake air throttle valve in an intake passage thereof for regulating an intake air quantity of the intake passage, and the intake air quantity is throttled in the second temperature increase more than the first temperature increase when the intake air throttle valve is controlled to increase the temperature of the particulate filter.

12. The method as in claim 8, wherein the temperature of the particulate filter is estimated on the basis of an output of a temperature sensor provided at least one of upstream and downstream of the particulate filter.

13. The method as in claim 8, wherein the internal combustion engine has an injector for injecting fuel into each cylinder of the internal combustion engine in an injection mode of performing a main injection to produce a main engine output and at least one post-injection at a later crank angle than the main injection in a single heat cycle of the internal combustion engine, and an injection quantity of the main injection is decreased in the second temperature increase as compared to the first temperature increase and an injection quantity of the post-injection in increased in the second temperature increase as compared to the first temperature increase when the temperature of the particulate filter is increased.

14. The method as in claim 13, wherein the ratio is set so as to perform temperature increase operation only with the first temperature increase when the estimated temperature is lower than specified temperature.

* * * * *